US007128012B2

(12) United States Patent
King

(10) Patent No.: US 7,128,012 B2
(45) Date of Patent: Oct. 31, 2006

(54) PULL-UP CLEAT WITH INFINITE POSITION ADJUSTMENT

(76) Inventor: William E King, P.O. Box 829, Kapaa, HI (US) 96746

( * ) Notice: Subject to any disclaimer, the term of this patent is extended or adjusted under 35 U.S.C. 154(b) by 0 days.

(21) Appl. No.: 11/335,219

(22) Filed: Jan. 18, 2006

(65) Prior Publication Data

US 2006/0112869 A1 Jun. 1, 2006

Related U.S. Application Data

(63) Continuation-in-part of application No. 10/848,223, filed on May 17, 2004, now abandoned.

(51) Int. Cl.
*B63B 21/04* (2006.01)

(52) U.S. Cl. ..... 114/218

(58) Field of Classification Search ..... 114/218; 403/104, 377

See application file for complete search history.

(56) References Cited

U.S. PATENT DOCUMENTS 2,614,770 A * 10/1952 Gabrielson ..... 242/599.1

6,588,355 B1 * 7/2003 Whitley et al. ..... 114/218

* cited by examiner

*Primary Examiner*—Sherman Basinger
(74) *Attorney, Agent, or Firm*—Dowrey Rickards PLLC

(57) ABSTRACT

A cleat assembly having a base adapted for mounting on a surface with the base having at least one depending hollow cylindrical guide tube which extends through the mounting surface The cleat assembly includes a cleat member having a head adapted to be received by and seated on the cleat base and at least one cleat post which is received in the base guide tube and reciprocally movable therein. An elastomeric keeper member is attached to the cleat post and frictionally engages the guide tube providing infinitesimal positions of adjustment. The elastomeric keeper member in one embodiment has a faceted surface with longitudinally extending grooves to allow passage of liquids and debris. The keeper elements may be secured to the cleat posts by fasteners which serve to radially expand the elastomeric keepers. Additonal areas of cushioned frictional contact are provided between the post and guide tube to dampen rattling.

30 Claims, 7 Drawing Sheets

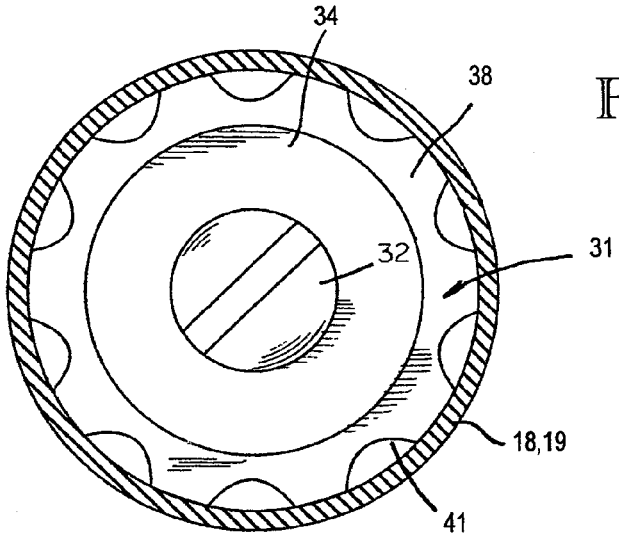
FIG.4
FIG.5
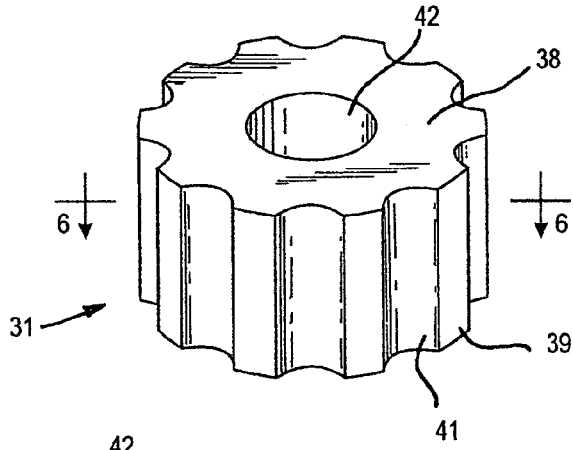
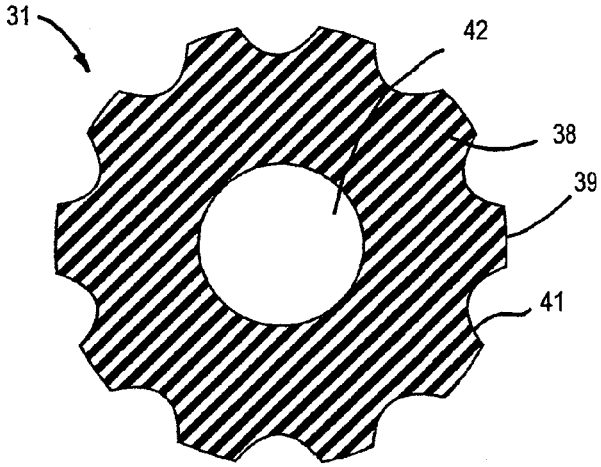
FIG.6

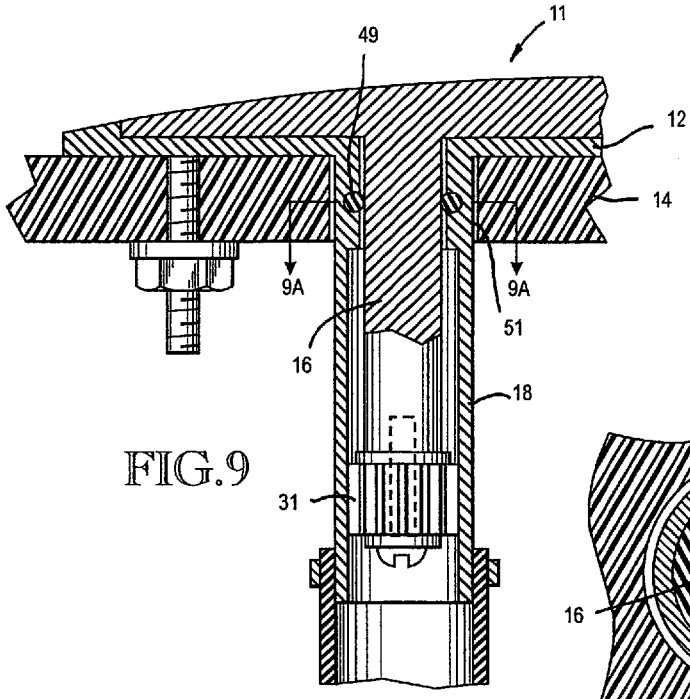
FIG.9
FIG.9A
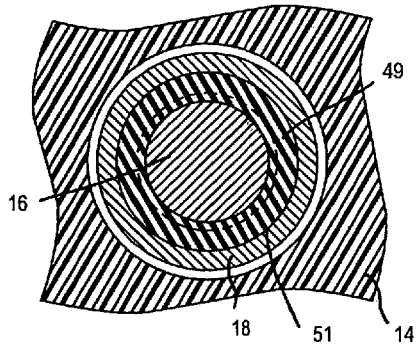
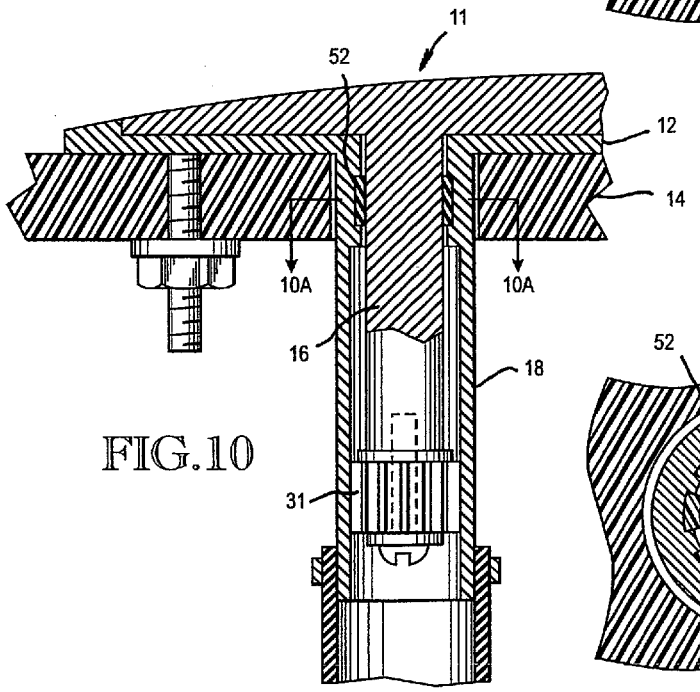
FIG.10
FIG.10A
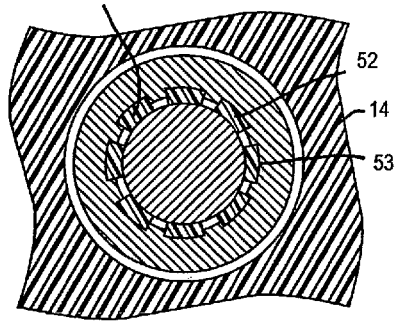

FIG.11B
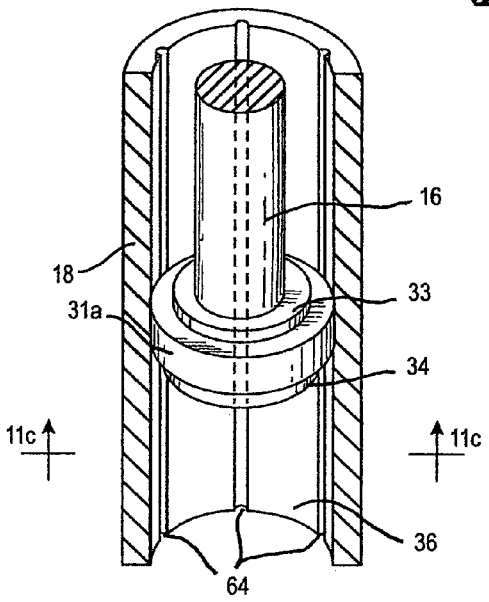
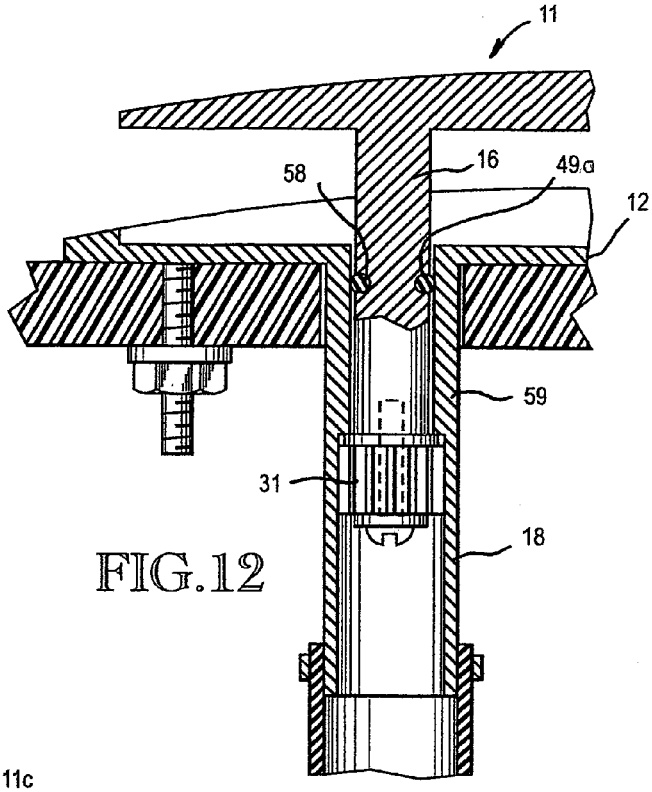
FIG.12
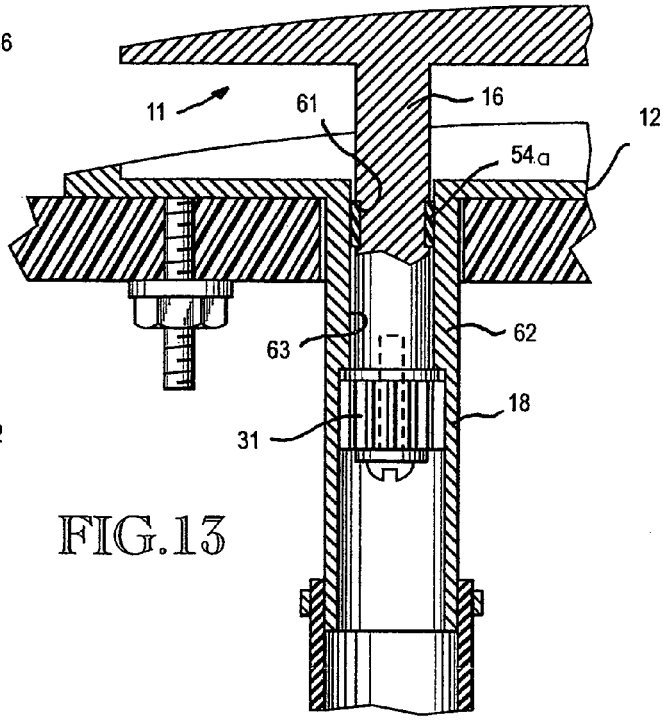
FIG.13
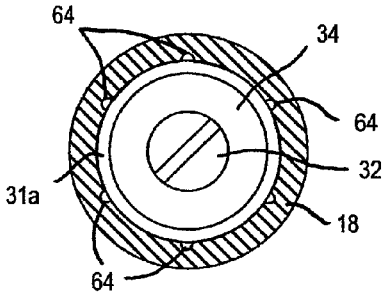
FIG.11C

PULL-UP CLEAT WITH INFINITE POSITION ADJUSTMENT

CROSS REFERENCE TO RELATED APPLICATIONS

The present application is a Continuation-in-Part of my application, filed May 17, 2004, Ser. No. 10/848,223 now abandoned.

FIELD OF THE INVENTION

The present invention relates to pull-up cleats such as used on the decks and rails of small boats, on Trucks, Rv's and other vehicles as well as on stationary structures. A cleat member may be moved to a raised position for securing ropes or mooring lines and returned to a retracted position so as not to interfere with use of the deck, railing or other mounting surface. More particularly, the pull-up cleat of the present disclosure incorporates a cleat position retention or keeper structure which provides for infinite increments of adjustment of the cleat member relative to its base throughout its motion. Drainage of liquids from the cleat base to a waste discharge conduit and vibration damping feature may also be provided.

DESCRIPTION OF THE PRIOR ART

The prior art contains many cleat and cleat operating designs which include both pull-up and pop-up types, the latter of which is usually biased upwardly to an operating position upon the release of spring pressure such as shown in U.S. Pat. No. 4,809,634 to Czipri. This type of cleat design usually requires some form of mechanical latching means to hold the cleat in the depressed position. The retractable or pull-up cleat normally employs some form of mechanical detent to hold the cleat member in either the raised position for use or the retracted or depressed non-use position. Cleats of this type utilize a cleat member with either a single or a double post or depending shaft structure mounted for reciprocation in a base mounted tubular guide structure for movement between the extended and retracted positions. The following listed patents are examples of the single post type cleat structures which include some form of mechanical latching to hold the cleat in the extended or the retracted position:

U.S. Pat. No. 6,234,101—Czipri
U.S. Pat. No. 5,301,627—Czipri
U.S. Pat. No. 4,672,909—Sweetsir
U.S. Pat. No. 4,354,445—Kafka et al.

The Czipri U.S. Pat. No. 6,234,101 above shows the common expedient of holding the cleat post member in either the extended or the retracted position by detent means and the Czipri U.S. Pat. No. 5,301,627 illustrates one form of mechanically latching the cleat in alternate positions. Another method of holding the cleat member in the raised operable position is that shown in U.S. Pat. No. 4,672,909 to Sweetsir and U.S. Pat. No. 4,354,445 to Kafka et al. In these devices, the cleat is raised to the extended position and rotated to hold it in position for use. These prior art cleat structures may either be of the type including a liquid sealed housing for preventing flow of liquid from the base member or some sort of drain or weep hole allowing discharge of liquid and debris. U.S. Pat. No. 5,983,820 to Whitley illustrates still another common type of cleat structure wherein the cleat member is provided with two downwardly depending posts or shafts which are housed in cylindrical guide tubes depending from the cleat base. In this instance, the cleat is held in either its extended or its retracted position by means of detents operating on both cleat posts with seals being provided to prevent any escape of liquid or debris from the cleat base.

Another type of lift-up cleat design is illustrated in the Whitley, II et al U.S. Pat. No. 6,588,355. The Whitley II et al patent discloses a double post or shaft type cleat which utilizes a cup-shaped flexible retainer, including an elastically deformable skirt connected to the bottom ends of the cleat posts to engage the inside surfaces of the guide tubes of the cleat base. The flexible skirts serve to retain the cleat posts in any position along the cylindrical guide tubes by engagement with the sides of the guide tubes. Liquid drainage from the cleat base is provided past the retainer skirts and is collected in a suitable drain conduit.

SUMMARY OF THE EMBODIMENTS

The present cleat structure includes a deck or other surface mounted base usually having a depression on the top surface thereof for reception of a retractable cleat member which may be of an elongated configuration conforming to the contours of the depression in the cleat base. The cleat member is provided with downwardly depending legs or posts which are received by cylindrical guide tubes extending from the bottom side of the base. Although a double cleat post and guide tube arrangement is illustrated, the present invention applies equally to a single post design. The tubular extensions on the base extend through appropriate bores in the supporting surface and the base member may be securely fastened to the supporting wall or structure by any well known means. In the present type of cleat structure, the posts are provided with ample clearance for reciprocation relative to the base within the tubular guides. This structure allows any liquid or debris, collecting on the exposed surface of the cleat base, to drain downwardly through the guide tubes and to be channeled to a drain system. In certain embodiments the structure may be configured to prevent or block any drainage downwardly through the guide tubes. The cleat member has a range of reciprocal motion of the downwardly extending posts within the tubular guides, the lower limit being determined by its seating in the cleat base and the raised position being limited by suitable stop means within the guide tubes. At least one or both of the cleat posts and/or guide tubes are provided with an elastomeric position retention member or keeper acting between the inside wall of the cylindrical guide tube and the post for restraining relative movement between the posts and the guide tube at any given location between the upper and lower limits of reciprocal motion. A surface on the elastomeric retention member thus acts between the post and guide tube surface to frictionally hold the cleat post in any position of adjustment and acts also as a guide member between the post and guide tube during reciprocation. This mode of operation is extremely important in allowing the operator to both raise and position the cleat member and to secure a line to the raised cleat with a single hand. Additionally, the elastomeric retention member may be provided with suitable channels on a peripheral surface which permits a free flow of liquid from the base member to suitable drainage conduits when desired. Alternatively the guide tubes may be provided with longitudinal drainage channels formed in the inside surface of the tube for the flow of liquid. In certain embodiments, the elastomeric retention members may be mounted on the bottom portion of the cleat posts with a screw threaded fastener which may also be utilized to radially expand the retention member so as to control the frictional engagement between the retention members and the inside wall of the guide tubes. In order to reduce vibration and, in some cases, rattling of the cleat member relative to its base, a second surface of cushioned contact or guide structure between the post and guide tube, spaced from the retention member, may also be provided.

BRIEF DESCRIPTION OF THE DRAWINGS

FIG. 4 is a partially sectioned bottom plan view of the guide tube with the retention member in place;

FIG. 5 is a perspective view of the elastomeric retention member;

FIG. 6 is a cross sectional view taken along lines 6—6 of FIG. 5;

FIG. 9 is a partial vertical cross sectional view of an embodiment of the cleat structure utilizing a guide ring or guide structure between the post and guide tube;

FIG. 9A is a cross sectional view taken along lines 9A—9A of FIG. 9;

FIG. 10 is a partial vertical cross sectional view of the cleat structure utilizing a second embodiment of guide structure between the post and guide tube;

FIG. 10A is a cross sectional view taken along lines 10A—10A of FIG. 10;

FIG. 11B is a partial vertical cross sectional view of an alternative embodiment utilizing drainage channels formed in the guide tube surface;

FIG. 11C is a cross sectional view taken along lines 11C—11C of FIG. 11B;

FIG. 12 is a partial vertical cross sectional view of the cleat structure for mounting the guide ring structure of FIGS. 9–9A on the post member; and FIG. 13 is a partial vertical cross sectional view of the cleat structure for mounting the guide structure of FIGS. 10–10B on the post member.

DETAILED DESCRIPTION OF THE EMBODIMENTS

Figure 1:
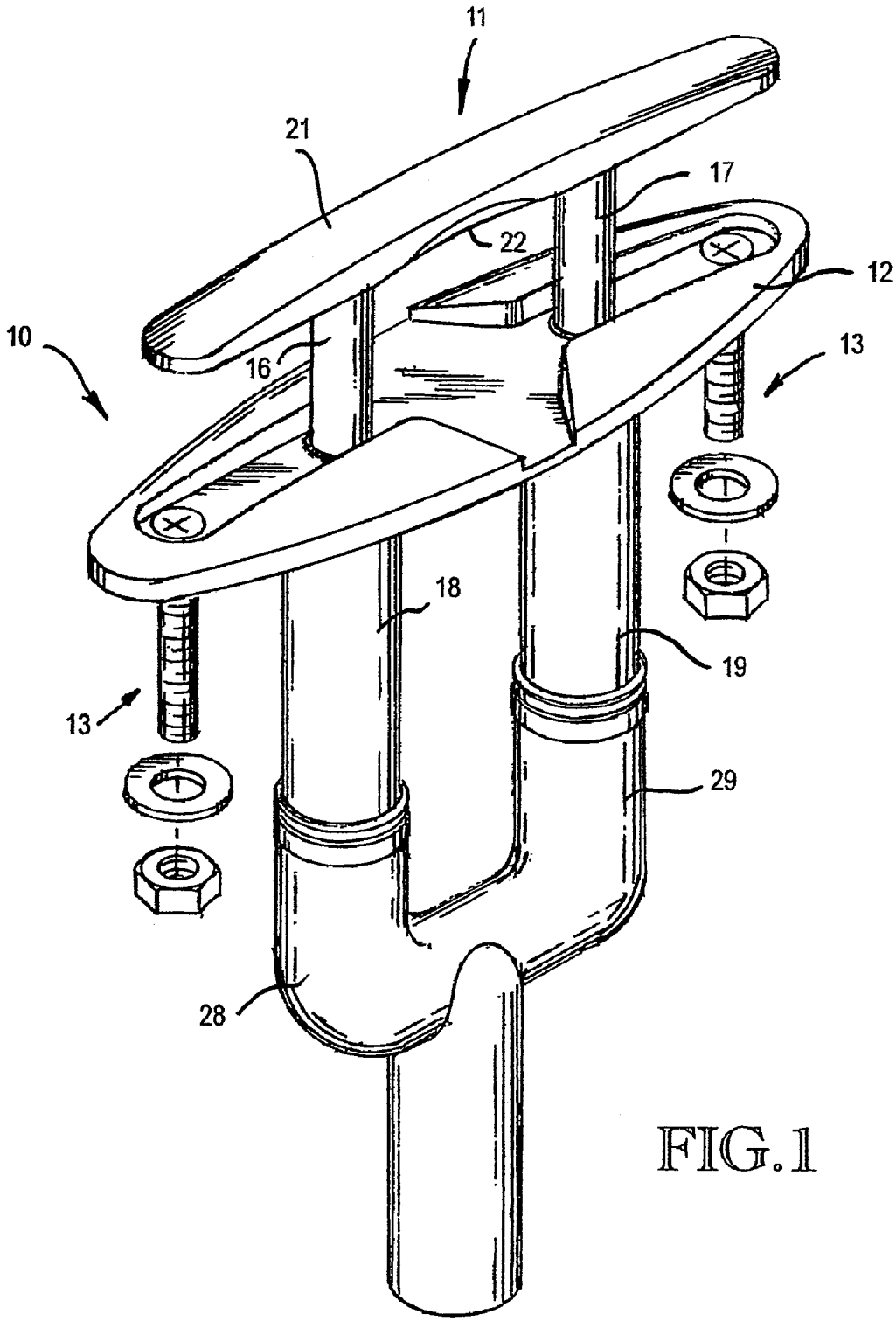
FIG. 1 is a perspective view of the raised position of the cleat member.
Figure 2:
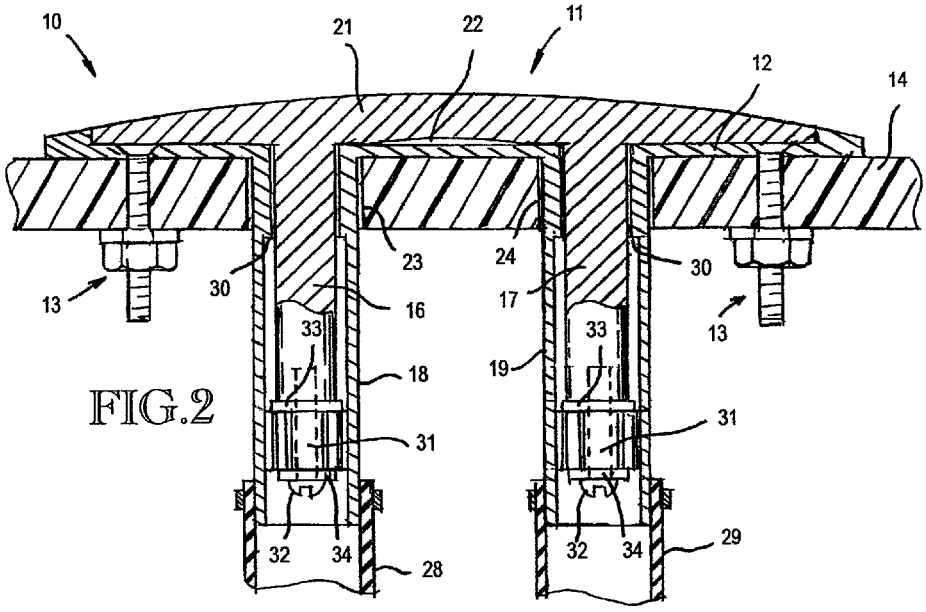
FIG. 2 is a vertical cross sectional view of the cleat structure with the cleat member in the retracted position.
Figure 3:
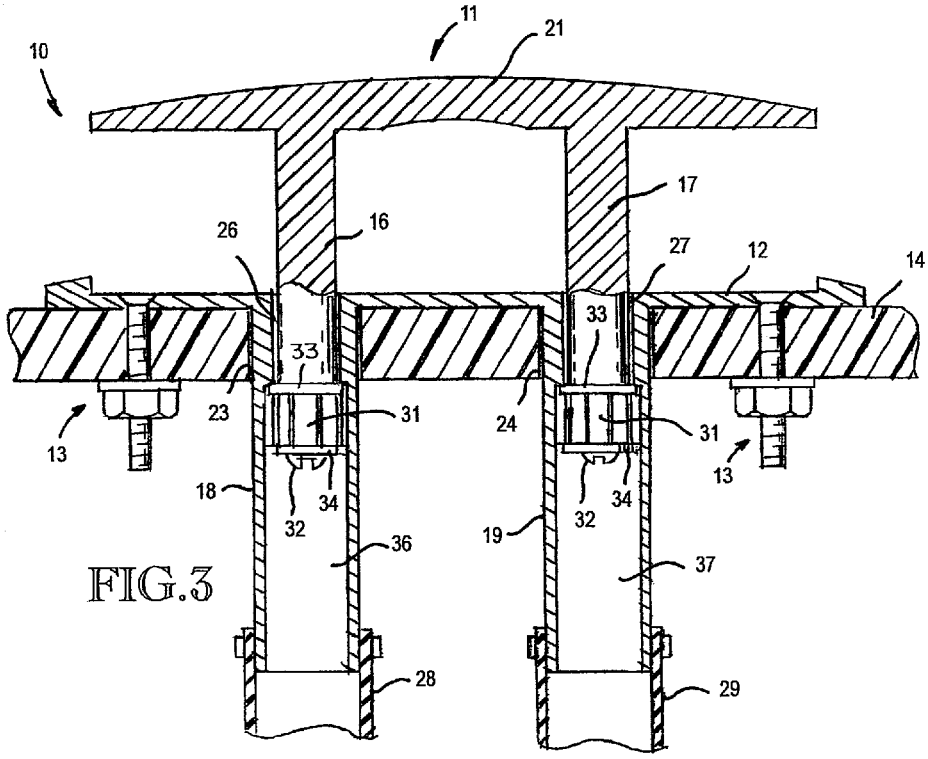
FIG. 3 is a cross sectional view similar to FIG. 2 showing the cleat member in the raised position.

Although the disclosed embodiments will be described with reference to a cleat structure and its mounting on a boat deck, it will be understood that the cleat is not limited to the application shown and may be utilized in other environments such as trucks, RVs or any other environment where a pull-up cleat is desired. Although the present embodiments are described as mounted on a generally horizontal surface, it will be appreciated that the structure may be mounted on surfaces otherwise oriented, such as a wall or a railing. Referring to FIGS. 1–3 of the drawings, the cleat structure is indicated generally at 10 and includes a pull-up cleat member 11, a cleat base 12 and clamping means 13 for securing the cleat base to a boat deck, a wall or other surface. FIG. 1 illustrates the cleat structure prior to mounting on a surface and FIGS. 2 and 3 illustrate the cleat apparatus mounted to a surface such as a boat deck 14.

Referring to FIGS. 1 and 2, it will be understood that the various components of the cleat apparatus such as the cleat member 11, the cleat base 12 and the anchoring members 13 may be made from any material and are commonly constructed from stainless steel castings or some other durable material of sufficient strength which is capable of resisting rust and corrosion. The cleat member comprises an elongated body with legs or posts 16 and 17 depending at right angles from the bottom side as seen in the drawings. Posts 16 and 17 are mounted for reciprocal movement within the cylindrical tubular members 18 and 19 respectively which extend at right angles from the bottom side of the base 12. Thus the cleat member 11 may be moved between the retracted position shown in FIG. 2, seated on the top surface of the cleat base, and the raised or operative position shown in FIGS. 1 and 3, above the cleat base 12. As seen in FIGS. 1–3, the head portion 21 of the cleat is an elongated bar which may have an arched center section 22 for grasping the bar when in the retracted position. As shown most clearly in FIG. 2, the center arched section 22 is slightly raised above the surface of the cleat base when the cleat member is in the retracted position.

The downwardly directed cylindrical guide tubes 18 and 19 of the base 12 are positioned for receiving the posts 16 and 17 respectively of the cleat member 11. The tubular members 18 and 19 may be formed as an integral casting with the base 12 or may be formed in any other suitable manner so as to be rigidly connected to the base 12. With the cleat base 12 resting on the surface of the deck 14, the tubular members 18 and 19 extend through suitable bore holes 23 and 24 respectively in the deck 14 with the cleat base 12, in the illustrated embodiment, being rigidly connected to the deck by means of the anchor bolts 13. Although the anchor bolts 13 are shown as attached to the bottom of the base 15 by such means as welding, it will be understood that the anchor bolts may be separate and passed through suitable holes in the base. As aforementioned, cleat posts 16 and 17 are received within the cylindrical tubes 18 and 19 with sufficient clearance, as shown at 26 and 27 in FIG. 3, between the posts and the upper ends of the tubes 18 and 19, to permit reciprocation. In the illustrated embodiment, clearance is provided for the passage of liquid or debris, collected on the top surface of the base 12, downwardly through the tubes 18 and 19 to a discharge area such as a bilge. Any liquid passing through the guide tubes is collected by the discharge conduits 28 and 29 sealingly attached or clamped to the bottom ends of the tubes. The discharge conduits 28, 29 may comprise rubber, vinyl or other plastic tubing. It will also be noted that the upper end of each of the guide tubes 18 and 19 is provided with a reduced inside diameter portion resulting in a shoulder forming a stop surface 30 which cooperates with the retention or keeper member assemblies in a manner presently to be described to provide an upper limit of travel of the cleat member as shown in FIG. 3.

According to the present embodiments, elastomeric keeper members, indicated generally at 31, are attached to the bottom ends of each of the posts 16 and 17 and may be identical in structure and function. The details of the keepers 31 are shown in one embodiment in FIGS. 4–6. The keepers 31 may be fabricated from rubber, nylon or other elastomeric deformable plastic material by any known process such as extrusion or molding. As seen most clearly in FIGS. 2 and 3, the keepers 31 may be attached to the bottom ends of the cleat posts utilizing screw fasteners such as machine screws 32 which engage screw threaded bores in the bottom of the associated posts. Stainless steel washers 33 and 34 may be used as rigid contact pressure surfaces or spacers between the keepers and the ends of the cleat posts and screw members 32. The washers 33 and 34 will, of course, be sized so as to avoid any contact with the inside surfaces of the guide tubes. As shown in FIG. 3, the washer 33 also contacts the shoulder 30 to provide a stop for limiting upward travel of the posts. It will be appreciated that, when the screw members 32 are tightened in the bottom of the posts, the keepers 31 will radially expand the desired amount to frictionally engage the inside surfaces 36 and 37 respectively of the tubes 18 and 19.

Although the top ends of the keeper members are illustrated as being in full surface contact with the upper washers 33 which in turn contact the terminal ends of the posts 16–17, the detail of the interface between the end portions of the posts, the washers and keepers may be modified without departing from the spirit and scope of the invention. The described embodiment thus provides an upper limit of travel by action of the washer 33 and an adjustable frictional engagement between the cylindrical surface of the keeper and the guide tube walls.

As viewed in FIGS. 4–6, the keepers 31 of the illustrated embodiment comprise an elongated cylindrical body. The outside surface of the keeper body comprises a faceted cylindrical surface 39 of the same nominal diameter as the inside diameter of the tubes 18 and 19. Faceted surface 39 is formed by the longitudinal grooves 41 and a central bore 42 extends the length of the body of the keeper for reception of the screw member 32. With this arrangement, the keepers 31 can be clamped to the bottom ends of the posts 16 and 17 and screw members 32 tightened to radially expand the keeper body to provide sufficient friction between the keepers 31 and the inside surfaces of the tubes 18 and 19. The engagement of the keepers releasably holds the cleat member 11 at any chosen location between the retracted and extended positions, providing infinitesimal incremental position adjustment of the cleat. In order to augment the frictional engagement between the surfaces of the keepers 31 and the inside surfaces 36 and 37, either or both surfaces may be provided with a roughened finish or treated with a friction enhancing coating. In the event that undue wear occurs on the surfaces of the keeper 31 in the present embodiment, it is merely necessary to tighten the screw member 32 to further compress and radially expand the elastomeric body of the keeper. Grooves 41 provide for ample passage of liquid or debris from the cleat base, down the tubes 18 and 19 and into the discharge conduits 28 and 29. In the alternative, if the guide tubes are otherwise sealed about the reciprocating posts, it is possible to optionally utilize a continuous cylindrical surface on the keepers.

As shown in FIG. 2, when in the retracted position, the cleat head 21 of the cleat member 11 is seated within the depressed surface of the cleat base 12 and is releasably held in this position by the frictional engagement of the keepers 31. When the cleat member is raised to the operative position by hand lifting pressure as shown in FIG. 3 for securing a line, the extreme limit of upward travel of the posts 16 and 17 is determined by engagement between the washers 33 and the shoulders 30 on the guide tubes 18 and 19. It will be noted that, except when in the retracted position seated in the base, as shown in FIG. 2, the provision of clearance between the cleat posts and guide tubes may give rise to a certain amount of rattle within the cleat structure or assembly. This becomes more likely, of course, when the assembly is mounted on a motorized vehicle, such as a boat or land vehicle, due to engine vibrations and/or vehicle travel vibrations. This has sometimes been a problem in the prior art with mechanical cleat retentions or when there is only one point of retention contact between post and guide tube. The present elongated configuration of the keeper or retention member thus provides increased area for effectively damping such vibrations or rattle.

Figure 7:
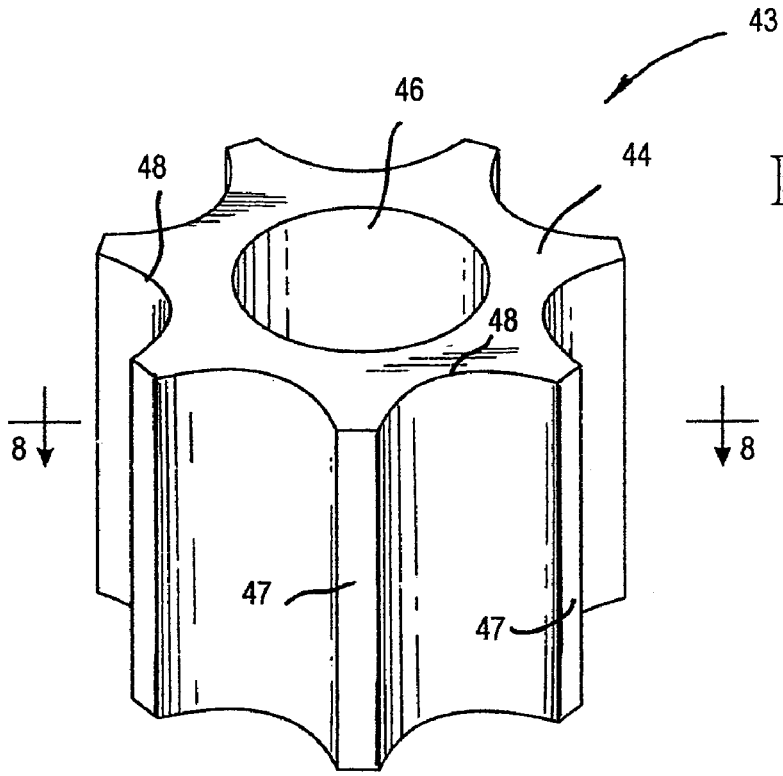
FIG. 7 is a perspective view of a second embodiment of the elastomeric retention member.
Figure 8:
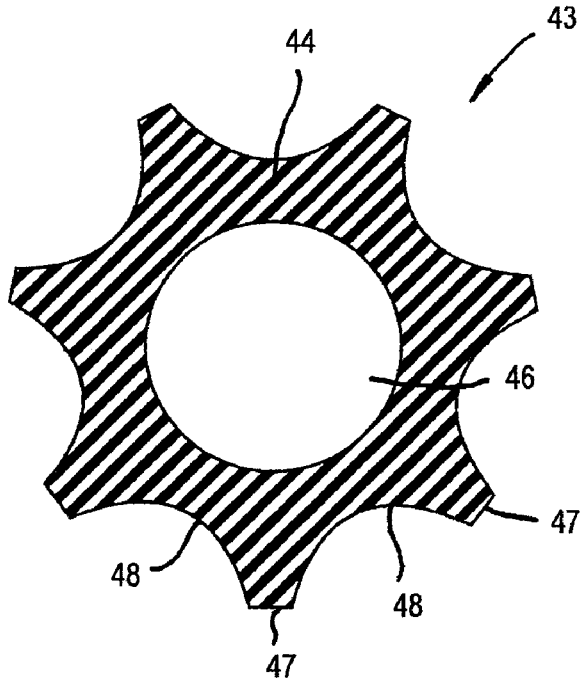
FIG. 8 is a cross sectional view taken along lines 8—8 of FIG. 7.

It will be noted that the exact dimensions of the faceted surface 39 of the keeper, as well as the depth and configuration of the grooves 41 may be varied depending upon the amount of liquid flow desired and/or the amount of surface area of frictional contact between the faceted surface 39 and the inside surface of the guide tubes required. In this regard, it is to understood that, although shown as having semi circular surfaces in the illustrated embodiments, the grooves 41 may take any form in cross section and are not limited to any specific configuration as long as adequate frictional contact and flow of liquid is provided in any particular installation. FIGS. 7 and 8 illustrate a second embodiment of cleat post keeper or restraining element. The keeper element, indicated generally at 43, includes the elastomeric body 44 having a central through bore 46. The length or longitudinal extent of the keeper body 44 may be varied for any particular installation and will depend upon the size and configuration of the guide tubes 18 and 19 as well as the amount of frictional contact desired between the keepers and the inside walls of the guide tubes. As described for the FIGS. 4–6 embodiment, the keeper 43 has an outside cylindrical faceted surface made up of the surface sections 47 with intervening grooves 48 extending the length of the keeper body. The grooves 48, of course, provide for passage of liquid and debris to the drain conduits 28 and 29 as previously described. It will be noted that the grooves 48 in the FIGS. 7–8 embodiment are fewer in number than those illustrated in the FIGS. 4–6 embodiment and are of greater circumferential extent, providing each groove with a greater cross sectional area for liquid flow. This embodiment, of course, provides less frictional contact between the faceted surface sections 47 and the inside surface of the guide tubes 18 and 19.

FIGS. 9 and 9A illustrate an embodiment of the cleat structure which provides a second area or point of cushioned contact between the cleat post and the guide tube. FIG. 9 is an illustration of only one of the post and guide tube arrangements. For purpose of illustration, the structural details of the cleat base, cleat member, guide tube and cleat post along with the keeper member will be understood to be identical to that explained with respect to FIGS. 2 and 3. In FIG. 9, the cleat member is shown in the retracted position and is seen to include a resilient annular contact ring 49 which may be in the form of a well known O-ring seal or the like composed of an elastomeric material such as described for the keeper member 31. As shown in FIGS. 9 and 9A, the ring 49 is mounted in an annular recess 51 formed in the reduced diameter opening in the guide tube 18. In this embodiment, the elastomeric ring 49 provides a second annular cushioned contact and guide structure for the reciprocating post 16 within the clearance provided between the post and the guide tube. Since the contact areas of the ring 49 and the expandable elastomeric guide member and keeper 31 are spaced, even with the cleat in the raised position, vibration and rattling of the cleat member within the cleat base is substantially eliminated and the contact ring 49 maintains the post in alignment with the tube during its travel. It will be understood, of course, that with the use of a continuous O-ring configuration for the ring 49, it may be unnecessary to provide drainage channels in the keeper member 31 if reliance is had on the O-ring to prevent moisture from entering the lower part of the guide tube. However, the channeled or grooved keeper 31 in any event will insure against collection of moisture in the guide tube. It will be understood that the guide structure or ring 49 need not be a closed or continuous ring but may comprise a split or segmented grouping for multiple cushion points if the O-ring 49 is not relied upon as a seal. Either configuration will be designed, of course, to provide a second point or set of points spaced from the keeper 31 for preventing or dampening vibration of the post within the guide tube.

Figure 10B:
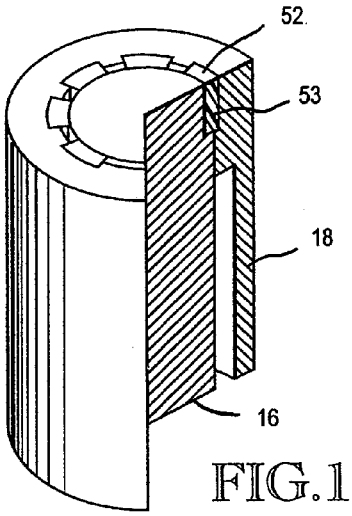
FIG. 10B is a sectional perspective view of the guide structure of FIG. 10.

FIGS. 10, 10A and 10B illustrate another modification of a vibration dampening structure wherein a second set of points or areas of cushioned contact between the cleat post and guide tube is provided by a guide structure including a series of axially elongated spaced contact pads or segments 52. The segments 52 are mounted in circumferentially spaced recesses 53 arranged about the post 16 in the upper end of the guide tube 18. The pads or segments 52 may also be constructed of an elastomer or other cushioning material and may be of the same composition as the material used in the keeper member 31. Referring to FIGS. 10A and 10B, the segments 52 are sized so as to fit snugly and be retained in the annular recesses 53 in the upper portion of the guide tube, axially spaced from the keeper 31. It will be noted that the surface contact between the segments 52 and the post 16 provides a sliding contact which will inherently produce some drag or frictional force on the reciprocating post. If desired, this may be utilized to augment the sliding frictional contact provided by keeper 31. Circumferential spacing of the segments also provides drainage channels in the manner previously described.

Figure 10C:
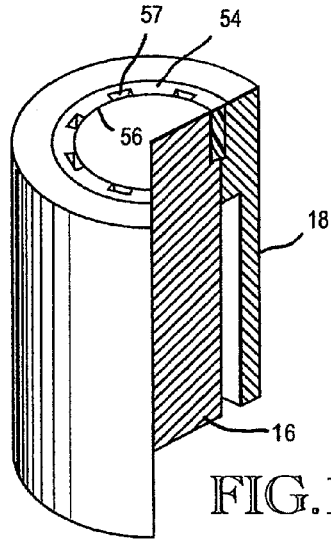
FIG. 10C is a sectional perspective view of an alternative embodiment of the guide structure of FIG. 10.

FIG. 10C illustrates still another embodiment wherein the second area of cushioned contact is provided by a guide structure including a somewhat elongated elastomeric cylindrical sleeve 54. In this embodiment, the sleeve 54 has a cylindrical inside surface which is faceted so as to form alternate ribs and grooves 56 and 57 respectively, providing a sliding contact with the outer surface of the cleat post 16. The grooves 57 may function to allow passage of water or other fluids and debris downwardly through the guide tube and past the keeper 31. In the alternative, a continuous inside surface may be provided on the sleeve 54 if it is desired to provide both a fluid seal and a dampening function between the post and guide tube. In sizing the inner diameter of the sleeve 54, it may be desirable to provide for a tight sliding frictional contact between the sleeve and the surface of the post much in the same manner as between the keeper 31 and the guide tube surface. If this approach is utilized, it will augment the retention function of the keeper 31 as well as provide a guide and vibration dampening for the assembly. As explained in the case of the keeper 31, the contact surface between the tubular guide sleeve 54 and the post may be provided with any known friction enhancing treatment to provide the desired degree of retention therebetween. It will also be understood that the details of the configuration of the ribs and grooves on the sleeve 54 may be altered for the purpose of adequate fluid passage and/or frictional engagement desired.

Figure 11:
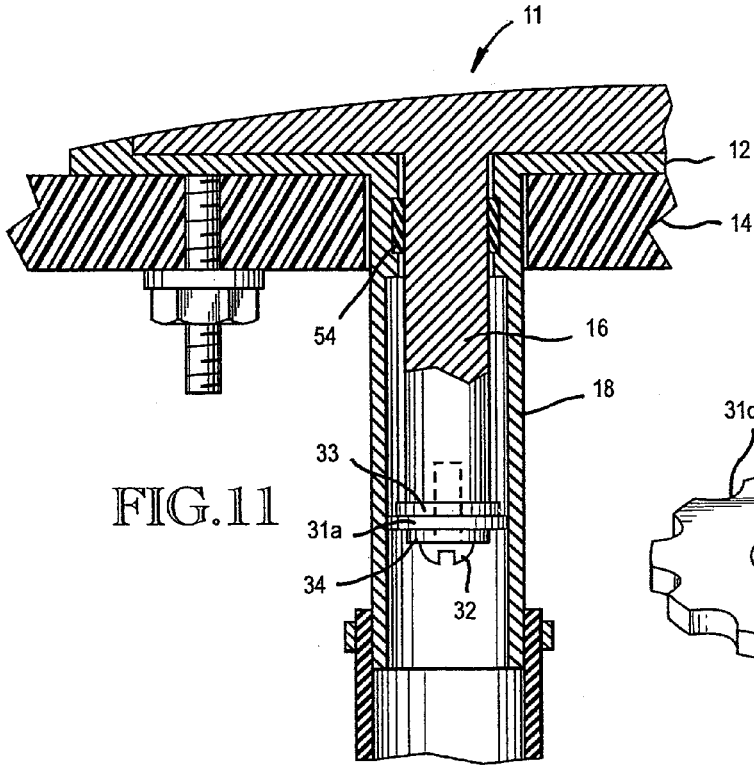
FIG. 11 is a partial vertical cross sectional view of an embodiment of the cleat structure utilizing a second embodiment of keeper guide member mounted on the bottom end of the post member.
Figure 11A:
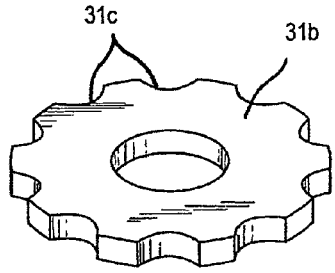
FIG. 11A is a perspective view of an alternative embodiment of the keeper guide member of FIG. 11.

FIG. 11 illustrates a modification of the elastomeric member attached to the bottom end of the guide post 16. In this embodiment the member 31*a* comprises an elastomeric disc or washer which may be attached to the bottom end of the post 16 in the same manner as previously described for the elongated keeper element 31. Although the precise thickness of the disc 31*a* may be varied, the preferred thickness is in the range of 3/16–1/4 inches and the disc may be made from the same material described for keeper 31 or any other suitable elastomeric material. It is to be understood that, while a preferred range has been stated, the washer may exceed the stated dimensional range in either direction without departing from the broader scope of the invention. The same rigid washers 33 and 34 may be used to clamp the elastomeric disc to the terminal end of the post 16 by means of the screw threaded member 32. In this instance, the disc shaped washer 33*a* is not radially expandable to any significant degree due to its relatively thin vertical cross section but, since it has no appreciable axial elongation, needs only to be sized to contact the inside surface of the guide tube 18 so as to act as a guide member and to restrain any substantial lateral movement of the post end within the guide tube. The disc is preferably sized to provide a certain amount of wiping action "drag" so as to create restraining action on the telescoping movement of the post within the guide tube 18. In this embodiment, the washers 33 and 34 will also prevent any "rolling" of the thin washer as it moves along the tube wall. In any event the combined "drag" or sliding friction provided by the washer 31*a* and any other second guide structure will be chosen to provide the restraining force necessary to hold the cleat in any selected position along its travel path. If drainage past the washer 31*a* is desired, notches or cut-away areas may be made in the peripheral edge of the disc, forming a scalloped peripheral edge. This alternative embodiment is illustrated in FIG. 11A wherein the elastomeric disc 31*b* is provided with cut-away or notched areas 31*c* in the outer peripheral edge forming the scalloped washer to provide a drainage path. The cut-away areas 31*c*, of course, may be of any configuration and the peripheral spacing varied to permit the volume of drainage desired.

Referring to FIG. 11, the guide structure or contact cylinder 54, as illustrated and described with reference to FIG. 10C, may be utilized in the upper end of the guide tube 18 to provide additional restraint or retention on the telescoping action of the post and guide tube. These elements will be sized so as to provide adequate restraint on the movement of the post so as to be positionable at any point of adjustment along its travel path. It will also be understood that, instead of the cylindrical sleeve 54 described, segmented contact pads, an elastomeric O-ring 49, or its variations of guide structure described may be utilized for providing the second spaced cushioned contact between the cleat post and guide tube to obtain the vibration dampening or rattle prevention described.

FIGS. 11B and 11C illustrate an alternative structure for providing liquid drainage from the guide tube 18 by means of drainage channels located on the inside surface of the tube. As shown in FIGS. 11B and 11C, the inside surface 36 of the guide tube 18 is provided with one or more liquid drainage channels 64 which are arranged about the inside peripheral surface of the tube. These drainage channels may be of any design and cross section and of sufficient dimensions to drain whatever moisture may collect in the tube around the keeper 31*a*. If multiple channels are utilized, they may be strategically placed about the keeper element and may extend a sufficient distance along the length of the tube in order to provide adequate drainage. It will be understood, of course, that the drainage channel configuration shown in FIGS. 11B and 11C may be utilized with any configuration of elastomeric keeper element and may also be utilized as an alternative to providing water passage around any design of guide element as previously described. Thus the drain channel or channels 64 may provide the total drainage required or may be utilized to augment the drainage capabilities of the grooved keeper and cleat post guide structures described.

FIGS. 12 and 13 illustrate alternative structures wherein, as shown in FIG. 12, the O-ring or annular guide structure and cushioning element 49*a*, similar to that shown at 49 in FIG. 9, may be mounted in a suitable annular recess 58 in the cleat post 16. In this embodiment, it may be necessary to lengthen the reduced diameter opening in the upper wall 59 of the guide tube in order to retain the O-ring guide structure within the reduced diameter opening throughout the travel path of the post between its extreme extended and retracted positions. It will be understood also that the ring 49*a* need not be a closed ring but may comprise a split or segmented grouping for multiple cushion points if the ring is not relied upon as a seal. FIG. 13 illustrates a similar arrangement wherein the elastomeric sleeve 54*a* guide structure is mounted in a suitable recess 61 in the surface of the cleat post. In this embodiment it may also be necessary to extend the length of the reduced diameter opening of the upper guide tube wall as shown at 62 to insure that the guide sleeve remains within the confines of the upper wall portion throughout the travel path of the cleat post between its raised and retracted positions. The details of the guide sleeve structure and its composition may be identical to that previously described except for the fact that the ribs and grooves of the sleeve 54*a* would, of course, be formed on the outside surface of the guide sleeve so as to contact the inside surface 63 of the guide tube wall as illustrated in FIG. 13. It would also be possible, of course, to utilize either the elongated keeper configuration 31 or the relatively thin elastomeric disc 31*a* as shown and described in connection with the FIG. 11 embodiment. Further, as described and illustrated in the FIG. 10B embodiment, it will be apparent that a second contact between the cleat post and guide tube may be provided by a guide structure including a series of axially elongated circumferentially spaced segments mounted in suitable recesses in the post surface.

The present pull-up cleat assembly concept in its broadest scope provides significant improvements in retractable cleat positioning structure allowing for infinitesimal incremental position adjustments and a single handed manipulation for operating the cleat and securing a line thereto. Additional novel improvement may also be provided by damping or eliminating rattling of the clamp post within the guide tube due to engine or vehicle travel vibrations. Simplicity of structure is achieved, avoiding the necessity of moving mechanical parts and consequent wear and replacement problems. The elastomeric keeper elements are extremely reliable, durable and inexpensive to manufacture and capable of adjustment, both initially and to compensate for subsequent wear.

Although a preferred embodiment of the invention has been illustrated and described herein with certain modifications, it is to be understood that the present disclosure is made by way of example and that various other embodiments and modifications are possible without departing from the inventive concept and are included within the scope of the following claims, which claimed subject matter is regarded as the invention. For instance, although the cleat tube and post configuration has been illustrated as being constructed of right circular cross sectional members in a traditional manner, it will be understood that other cross sectional configurations for these members may be used without departing from the spirit and scope of the invention and are to be considered to be covered by the appended claims unless otherwise limited. The aim of the appended claims therefore is to cover all such changes and modifications as fall within the true spirit and scope of the invention.

What is claimed is:

1. A pull-up cleat assembly comprising;

a base member having a bottom surface for engaging a mounting surface and a top surface seating a pull-up cleat member, said base member including at least one guide tube with an inside guide surface, said guide tube projecting from the bottom surface of the base member and communicating with the top surface thereof, said cleat member including at least one post extending therefrom and an end portion telescopingly received in said guide tube for reciprocal movement, an elastomeric guide member connected to the end portion of said post and sized so as to reciprocate within said guide tube and comprising a first guide member between the post and said guide tube, an elastomeric guide structure mounted between the inside surface of said guide tube and the surface of said post to provide sliding frictional contact therebetween, said elastomeric guide structure comprising a second guide member between the post and said guide tube, whereby substantial alignment between said post and said guide tube is maintained throughout reciprocal movement and vibration therebetween is dampened.

2. The pull-up cleat assembly of claim 1 wherein;

said elastomeric guide structure comprises;

an annular band of elastomeric material, said annular band of elastomeric material being contained in an annular recess in the inside surface of said guide tube for holding said band in frictional contact with the surface of said post during telescoping movement.

3. The pull-up cleat assembly of claim 2 wherein said annular band extends less than 360° about the annular recess.

4. The pull-up cleat assembly of claim 2 wherein said annular band comprises a plurality of segments circumferentially spaced about said annular recess.

5. The pull-up cleat assembly of claim 2 wherein;

said elastomeric guide structure comprises an elongated cylindrical sleeve, said sleeve having an outside surface contacting said recess and an inside surface contacting the surface of said post.

6. The pull-up cleat assembly of claim 5 wherein;

the inside surface of said sleeve includes at least one longitudinal drainage groove thereon extending the length thereof.

7. The pull-up cleat assembly of claim 1 wherein;

said elastomeric guide structure comprises;

an annular band of elastomeric material, said annular band being contained in an annular recess in the surface of said post for holding the band in frictional contact with the inside surface of said guide tube during telescoping movement.

8. A pull-up cleat assembly according to claim 1 wherein;

said elastomeric guide member comprises an elongated keeper in sliding frictional contact with the inside surface of said guide tube, said keeper body radially expandable by application of axial pressure and comprising a first area of frictional contact between said post and said guide tube, said first area of frictional contact being sufficient to retain said post in any selected position of longitudinal adjustment while allowing repositioning of the post by hand pressure on said cleat member said elastomeric guide structure comprising a second area of frictional contact between said post and said guide tube, whereby substantial alignment between said post and said guide tube is maintained throughout reciprocal movement and vibration therebetween is dampened.

9. The pull-up cleat assembly of claim 8 wherein;

said elastomeric guide structure comprises;

an annular band of elastomeric material, said annular band of elastomeric material being contained in an annular recess in the inside surface of said guide tube for holding said band in frictional contact with the surface of said post during telescoping movement.

10. The pull-up cleat assembly of claim 9 wherein said annular band comprises a continuous O-ring.

11. The pull-up cleat assembly of claim 9 wherein said annular band extends less than 360° about the annular recess.

12. The pull-up cleat assembly of claim 9 wherein said annular band comprises a plurality of segments circumferentially spaced about said annular recess.

13. The pull-up cleat assembly of claim 9 wherein said annular band comprises an elongated cylindrical sleeve, said sleeve having an outside surface contacting said recess and an inside surface contacting the surface of said post.

14. The pull-up cleat assembly of claim 13 wherein;

the inside surface of said sleeve includes at least one longitudinal drainage groove therein extending the length thereof.

15. The pull-up cleat of claim 1 wherein said elastomeric guide structure comprises;

an annular band of elastomeric material, said annular band being contained in an annular recess in the surface of said post for holding said band in contact with the inside surface of said guide tube during telescoping movement.

16. The pull-up cleat of claim 15 wherein said annular band comprises a continuous O-ring.

17. The pull-up cleat of claim 15 wherein said annular band extends less than 360° about the annular recess.

18. The pull-up cleat of claim 15 wherein said annular band comprises a plurality of segments circumferentially spaced about said annular recess.

19. The pull-up cleat of claim 15 wherein said annular band comprises an elongated cylindrical sleeve, said sleeve having an inside surface contacting said recess and an outside surface contacting the inside surface of said guide tube.

20. The pull-up cleat of claim 19 wherein;

the outside surface of said sleeve includes at least one longitudinal drainage groove therein extending the length thereof.

21. The pull-up cleat assembly of claim 1 wherein;

said elastomeric guide member comprises and elastomeric disc in sliding contact with the inside surface of said guide tube, said disc comprising a first area of frictional contact between said post and said guide tube, said elastomeric guide structure comprising a second area of frictional contact between said post and said guide tube, said first and second areas of frictional contact being sufficient to retain said post in any selected position of longitudinal adjustment while allowing repositioning of the post by hand pressure on said cleat, whereby infinite incremental adjustment of said post along the travel path of said post is provide, substantial alignment between said post and said guide tube is maintained and vibration therebetween is dampened.

22. The pull-up cleat assembly of claim 21 wherein;

sufficient clearance is provided between said post and said guide tube for passage of liquid, and at least one cut-away area is provided in the peripheral edge of said disc for drainage of liquid from said guide tube.

23. The pull-up cleat assembly of claim 21 wherein said disc has a thickness in the range of 3/16 to 1/4 inches.

24. The pull-up cleat assembly of claim 23 wherein;

sufficient clearance is provided between said post and said guide tube for passage of liquid, and at least one cut-away area is provided in the peripheral edge of said disc for drainage of liquid from said guide tube.

25. The pull-up cleat assembly of claim 21 wherein;

sufficient clearance is provided between said post and said guide tube for passage of liquid, and wherein said guide tube includes at least one longitudinally directed drainage channel in the inside surface thereof for drainage of liquid past said disc and said guide structure.

26. The pull-up cleat of claim 1 wherein sufficient clearance is provided between said post and said guide tube for passage of liquid, and wherein said guide tube includes at least one longitudinally directed drainage channel in the inside surface thereof for drainage of liquid past said first and second guide members.

27. In a pull-up cleat assembly having a cleat member with a cleat post having a terminal end portion thereof received for telescoping movement within a cleat base guide tube, a keeper member for restraining reciprocal telescoping movement of the cleat post within the cleat base guide tube comprising:

an elongated cylindrical keeper body having a central longitudinal through bore therein, connector means located in said through bore for connecting said keeper body to the end portion of said post, said keeper body including a radially deformable cylindrical elastomeric surface for sliding frictional contact with the guide tube, said keeper body being radially deformable by application of axial pressure theron, and said guide tube including at least one longitudinally directed drainage channel in the inside surface thereof for drainage of liquid past said keeper body, said frictional contact being sufficient to retain said post in any selected position of longitudinal adjustment while allowing repositioning of the post by hand pressure on the cleat member.

28. A cleat assembly comprising:

a base member having a bottom surface for engaging a mounting surface and a top surface seating a cleat member, said cleat member having a raised operative position and a retracted position for seating on the top surface of said base member, said base member including at least one guide tube with an inside guide surface, said guide tube extending from the base member, through said mounting surface and communicating with the base member top surface, said cleat member including at least one post extending therefrom with an end portion thereof telescopingly received in said guide tube for reciprocal movement therein along a travel path between the raised and retracted positions with sufficient clearance being provided between said post and said guide tube for passage of liquid, a keeper member having an elongated radially deformable cylindrical keeper body connected to the terminal end of said end portion of said post with an outside surface providing a sliding frictional contact between said post and the inside surface of said guide tube, a connector member comprising a headed screw threaded element for connecting said keeper body to the terminal end of the post, said keeper body comprising a cylinder of solid rubber material having a central longitudinal through bore therein for mounting said connector member, said connector member passing through said bore and received in a screw threaded opening in the terminal end of said post, said keeper body being radially expandable by axial pressure thereon to produce said frictional contact, a first rigid spacer between the keeper body and the head of said screw threaded element, whereby tightening the screw threaded element radially expands said keeper body to enhance the frictional contact thereof with the guide tube inside surface, a stop surface on said guide tube, a second rigid spacer between said keeper body and the terminal end of said post, said second rigid spacer being sized to contact said stop surface, whereby telescoping movement of said post is limited in one direction by engagement of said second rigid spacer and said stop surface and in the opposite direction by seating of said cleat member in the top surface of said base member, and said guide tube including at least one longitudinally directed drainage channel in the inside surface thereof for drainage of liquid past said keeper body, said frictional contact being sufficient to retain said post in any selected position of longitudinal adjustment while allowing repositioning of the post by hand pressure on said cleat member, whereby infinite incremental adjustment of said post along said travel path is provided.

29. In a pull-up cleat assembly, a method for infinite incremental longitudinal positioning of a cleat post within a base guide tube comprising the steps of;

providing sufficient clearance between said cleat post and said guide tube for passage of liquid, mounting an elastomeric radially deformable keeper body on the end portion of said cleat post, grooving the inside surface of said guide tube to permit drainage of liquid from said guide tube past said keeper body, applying axial pressure on the keeper body to radially expand the keeper body to provide sliding frictional contact with the guide tube and, maintaining said frictional contact sufficient to retain said post in any selected position of adjustment within said guide tube while allowing longitudinal repositioning of the post by hand pressure on the cleat member.

30. A cleat assembly comprising;

a base member having a bottom surface for engaging a mounting surface and a top surface seating a cleat member, said cleat member having a raised operative position and a retracted position for seating on the top surface of said base member, said base member including at least one guide tube with an inside guide surface, said guide tube extending from the base member, through said mounting surface and communicating with the base member top surface, said cleat member including at least one post extending therefrom with an end portion thereof telescopingly received in said guide tube for reciprocal movement therein along a travel path between the raised and retracted positions with sufficient clearance being provided between said post and said guide tube for passage of liquid, a keeper member having an elongated radially expandable cylindrical elastomeric keeper body connected to the terminal end of said end portion of said post with an outside surface thereof providing a sliding frictional contact between said post and the inside surface of said guide tube, a connector member comprising a headed screw threaded element for connecting said keeper body to the terminal end of the post, said keeper body having a central longitudinal through bore therein for mounting said connector member, said connector member passing through said bore and received in a screw threaded opening in the terminal end of said post, a first rigid spacer between the keeper body and the head of said screw threaded element, whereby tightening the screw threaded element radially expands said keeper body to enhance the frictional contact thereof with the guide tube inside surface, a stop surface on said guide tube, a second rigid spacer between said keeper body and the terminal end of said post, said second rigid spacer being sized to contact said stop surface, whereby telescoping movement of said post is limited in one direction by engagement of said second rigid spacer and said stop surface and in the opposite direction by seating of said cleat member in the top surface of said base member, and said guide tube including at least one longitudinally directed drainage channel in the inside surface thereof for drainage of liquid past said keeper body, said frictional contact being sufficient to retain said post in any selected position of longitudinal adjustment while allowing repositioning of the post by hand pressure on said cleat member, whereby infinite incremental adjustment of said post along said travel path is provided.

* * * * *